US005790480A

United States Patent [19]

Klatser

[11] Patent Number: 5,790,480

[45] Date of Patent: Aug. 4, 1998

[54] DELTA-T MEASUREMENT CIRCUIT

[75] Inventor: Paul Klatser, Oldenzaal, Netherlands

[73] Assignee: Fluke Corporation, Everett, Wash.

[21] Appl. No.: 854,864

[22] Filed: May 12, 1997

Related U.S. Application Data

[63] Continuation of Ser. No. 430,015, Apr. 27, 1995, abandoned.

[51] Int. Cl.[6] ..... G04F 8/00

[52] U.S. Cl. ..... 368/121

[58] Field of Search ..... 368/121, 113–120

[56] References Cited

U.S. PATENT DOCUMENTS

| | | | |
|---|---|---|---|
| 3,790,890 | 2/1974 | Doittau et al. | 368/121 |
| 4,251,754 | 2/1981 | Navarro et al. | 315/370 |
| 4,301,360 | 11/1981 | Blair | 235/92 T |
| 4,504,155 | 3/1985 | Ruggieri | 368/121 |
| 5,196,741 | 3/1993 | Rustici | 307/353 |

*Primary Examiner*—Bernard Roskoski
*Attorney, Agent, or Firm*—George T. Noe

[57] ABSTRACT

A method and apparatus for measuring very short time periods, or differences between two events, such as the delta-T between a trigger point on a waveform and a sampling clock edge of a digital oscilloscope. The delta-T measurements are made using the time-to-voltage transformation of an integrator. The output sweep ramp of the integrator is normalized to a fixed differential time and differential amplitude by correction current provided by a reference circuit that has a reference integrator substantially identical to the delta-T integrator. The reference integrator is operated at the same timing as the delta-T integrator, and an error correction loop furnishes the right amount of current to both integrators to normalize the peak voltage of both to a predetermined reference voltage.

6 Claims, 3 Drawing Sheets

DELTA-T MEASUREMENT CIRCUIT

This application is a continuation of application Ser. No. 08/430,015, filed Apr. 27, 1995, now abandoned.

BACKGROUND OF THE INVENTION

This invention relates generally to circuits for measuring small incremental time, and in particular to a circuit for accurately measuring the time difference between a trigger point and a sample pulse in a digital oscilloscope.

For display stability on an oscilloscope viewing screen, it is necessary that the horizontal time base sweep always start at substantially the same point on a waveform. This is achieved in analog oscilloscopes by generating a trigger to initiate a new sweep when the input signal passes through a selected triggering level, and the processed signal is delayed slightly to allow the sweep circuits to be initiated. In digital oscilloscopes, however, the input signal is broken up by a sampling clock into a series of evenly spaced instantaneous-amplitude points on the waveform, and the point on the signal at which a trigger is generated and the points on the signal at which samples are taken are unrelated to each other. Moreover, the digital oscilloscope continues to take samples and thus acquire input signals until a trigger comes along, either starting or stopping the waveform acquisition. In other words, the trigger point and the sample clock are completely unrelated and are asynchronous, resulting in a high probability of the trigger point falling between two sampling clock pulse edges. This problem becomes increasingly significant at higher signal frequencies that approach the sampling clock frequency. The small differential time between the trigger point and a sampling clock edge, known as $\Delta T$ (delta-T), must be measured for each sweep to shift the start of each displayed sweep to the same point, and thus allow the sampled points to appear at their corrected time positions. This problem was recognized early in the development of digital oscilloscopes, and now most digital oscilloscopes have some type of delta-T measurement.

One conventional method of making delta-T measurements is taught by U.S. Pat. No. 4,301,360, to Bruce Blair, wherein a short time period represented by the charging of a capacitor with a precise one-milliampere current is equal to one clock period of a sampling clock, and a high-speed counter counts a known number of counts for the clock period. Delta-T (the time between a trigger signal and a sampling clock edge) is measured by first switching a precise ten-microampere current into the capacitor, and then, when the sampling clock edge arrives, switching the one-milliampere current into the capacitor and at the same time, initiating the high-speed counter. By subtracting the count thus obtained from the known count, the delta-T is obtained. Such precision, however, requires expensive and carefully controlled manufacturing processes and components to produce circuitry that will perform in the manner necessary. It is very difficult to manufacture capacitors in integrated-circuit form that have the required accuracy, and tolerances of ±20% are common.

It would be desirable to measure small time differences in the nanosecond range with accuracies that are independent of the circuit components or manufacturing processes.

SUMMARY OF THE INVENTION

In accordance with the present invention, a method of and apparatus for measuring very short time periods, or time differences between two electrical events, such as the delta-T between a trigger point and a preceding or subsequent clock pulse edge, comprises an integrator whose output sweep ramp is started on a clock pulse edge and stopped on a trigger pulse (or started on a trigger pulse and stopped on a clock pulse edge) to perform as a time-to-voltage converter. The output sweep ramp is normalized to a fixed differential time and fixed differential amplitude, and thus providing a fixed slope to ensure an accurate time-to-voltage transfer function irrespective of the tolerance of the integrator capacitor or the tolerance of the current source furnishing charge current to the capacitor. The output of the integrator is applied to an analog-to-digital converter which produces digital data representative of the measured time, thus providing an accurate delta-T measurement circuit.

A reference circuit responsive to a predetermined differential time and a predetermined differential voltage provides a normalized transfer function for the delta-T measurement integrator. A reference integrator substantially identical to the delta-T measurement integrator circuit is operated at the same timing as the delta-T integrator to provide reference sweeps. The peak value of each reference sweep is sampled by a sample-and-hold circuit, and used to generate a DC control voltage for an error amplifier that compares the DC control voltage with a predetermined reference voltage. The error amplifier produces an output current that is used as the charging current for both integrators. Since the error amplifier produces whatever current is required by the reference integrator to normalize its ramp to a peak value of the reference voltage, the delta-T integrator is likewise normalized to the same voltage. Thus accurate time differential measurements may be made independent of manufacturing process deviations and component tolerances.

It is therefore one feature of the present invention to provide a novel circuit for making accurate delta-T measurements.

It is another feature of the invention to provide a time-to-voltage converter having a normalized transfer function.

It is another feature to provide an integrator with a normalized slope for accurate time-to-voltage conversion.

It is yet another feature to provide an integrator for differential time measurements in which integrated-circuit process deviation of parameters is canceled out.

Other objects, features, and advantages of the present invention will become obvious to those having ordinary skill in the art upon a reading of the following description when taken in conjunction with the accompanying drawings.

DETAILED DESCRIPTION OF THE INVENTION

Figure 1:
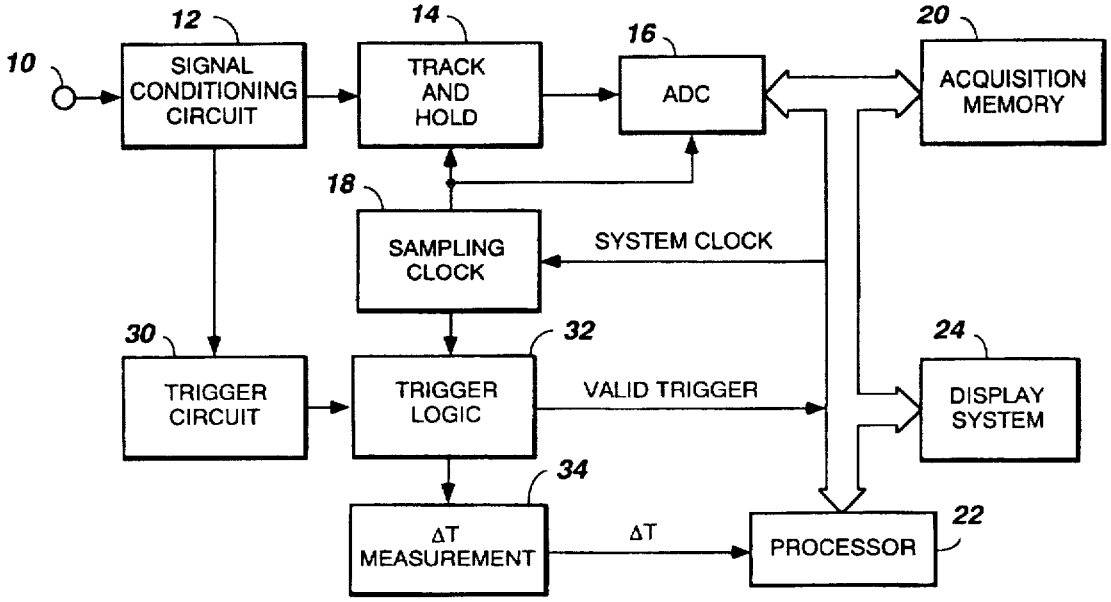
FIG. 1 is a block diagram of an acquisition system of a digital oscilloscope.
Figure 2:
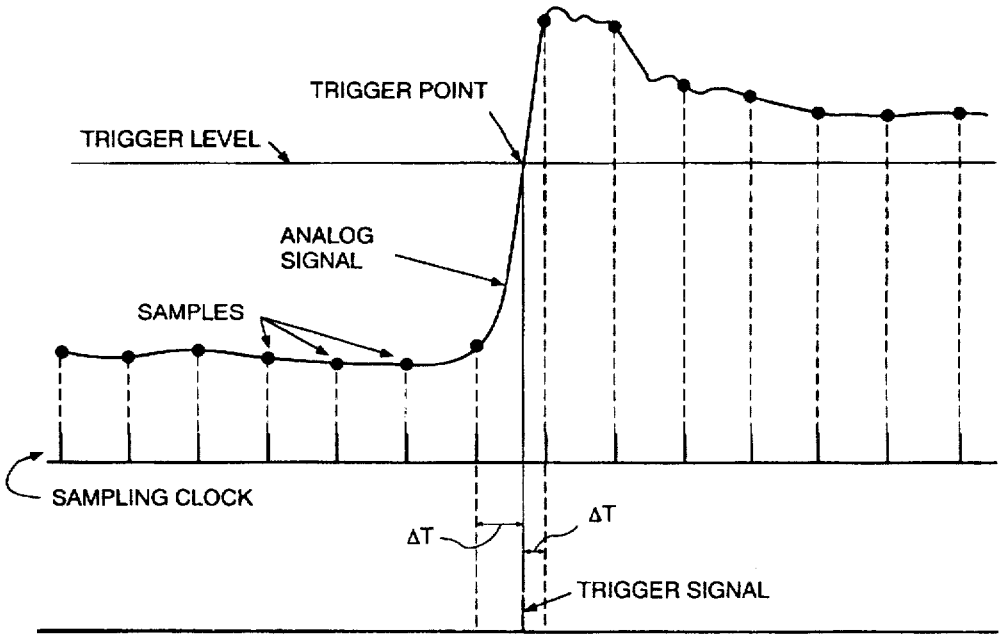
FIG. 2 is a waveform diagram to explain the system of FIG. 1.

Referring to FIGS. 1 and 2 of the drawings, there is shown in FIG. 1 a block diagram of the acquisition system of a digital oscilloscope that incorporates a delta-T measurement system in accordance with the present invention, and FIG. 2 is a waveform diagram to explain the system of FIG. 1.

An input analog signal is applied via an input terminal 10 to a signal conditioning circuit 12, which includes conventional input attenuators and gain-switched preamplifiers to adjust the signal amplitude to a level suitable for processing by a track-and-hold circuit 14 and analog-to-digital converter (ADC) 16. The track-and-hold circuit 14 and ADC 16 convert the instantaneous amplitudes (represented by large dots in FIG. 2) of the analog signal to digital representations at a rate established by sampling clock 18. The digital representations, or samples as they are also known, are stored in an acquisition waveform memory 20 for further processing and subsequent display by a processor 22 and display system 24.

The analog input signal is also applied from the signal conditioning circuit 12 to a trigger circuit 30, which may suitably include a conventional trigger comparator which generates a trigger signal when the input signal passes through a selected trigger level. Note in FIG. 2 that the point at which a trigger signal is generated is dependent on the input signal and the triggering level, and is not related to the sampling clock. The trigger signal and clock signals from the sampling clock 18 are passed to a trigger logic circuit 32, which issues a valid trigger to the processor 22 to either start or stop waveform acquisition, depending on the selected operating mode. The trigger logic circuit 32 also develops timing signals from the trigger and clock signal, and applies them to a delta-T measuring circuit 34. The measured differential time is then sent to processor 22 to establish the time positions of the acquired digital samples. As noted in FIG. 2, since the clock period is known, it is not critical as to which side of the trigger signal the delta-T measurement is made, as long as the system used is consistent to ensure that the acquired samples appear in their correct time positions.

Figure 3:
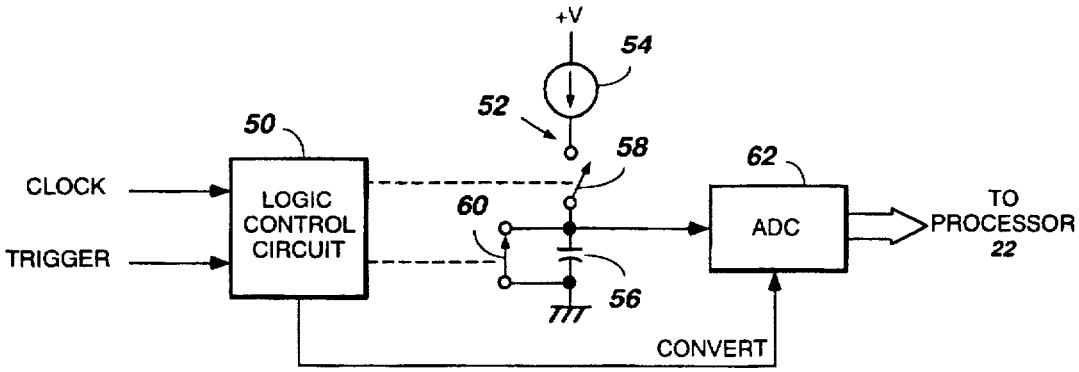
FIG. 3 is a partial delta-T measurement circuit in accordance with the present invention.

Before discussing the delta-T measurement 34 in accordance with the present invention in detail, it will be helpful in providing a complete understanding to first discuss delta-T measurement in simplified form. Refer to FIG. 3, which shows a partial delta-T measurement circuit 34 in simplified form, and to FIG. 4, which shows waveform diagrams to explain the circuit of FIG. 4. Clock signals which are derived from the sampling clock, and therefore occur at the sampling clock rate, are applied to a logic control circuit 50 along with the trigger signal. In the commercial embodiment, the sampling clock operates at a 25-megahertz rate, resulting in a 40-nanosecond clock period. Logic control circuit 50 develops a $T_{START}$ signal from a clock edge, and a $T_{STOP}$ signal from the trigger signal, developing an integrator gate pulse whose duration is from $T_{START}$ to $T_{STOP}$. The time $T_{STOP}$, then, falls at some point between times $T_{MIN}$ and $T_{MAX}$ in FIG. 4. The period $T_{MAX}-T_{MIN}$ is equal to one clock period. The incremental time from $T_{MIN}$ to $T_{STOP}$ is the delta-T being measured. The Integrator gate pulse is applied to a delta-T integrator 52 comprising a current source 54 and a capacitor 56 to gate the integrator on for the time period from $T_{START}$ to $T_{STOP}$. The integrator gate pulse closes a switch 58 and opens a switch 60, connecting the current source 54 to the capacitor 56. Current flowing into capacitor 56 causes the capacitor to charge toward a predetermined voltage $V_{MAX}$. After one full clock cycle, which ensures that non-linearities at ramp start-up do not affect the measurement, voltage level $V_{MIN}$ is reached, and the capacitor continues to charge until a trigger signal results in a time $T_{STOP}$. At this point, switch 58 opens, and capacitor 56 stops charging at some voltage $V_{MEASURE}$ between $V_{MIN}$ and $V_{MAX}$. After time $T_{MAX}$, logic control circuit 50 generates a convert signal, which is applied to ADC 62, which converts the voltage $V_{MEASURE}-V_{MIN}$ (delta-V) to digital data representing a precise value of delta-T, which is sent to processor 22 (in FIG. 1) to adjust the time positions of the acquired samples. After the conversion is complete, the integrator is reset by closing switch 60, shorting the capacitor.

Since accurate time-to-voltage measurements are being made, it is important that the ramp produced by the integrator always have a slope that is determined by a known time and a known amplitude, and always be the same slope for every measurement. In order for delta-T to be accurately transformed to delta-V, the slope, and hence, the transfer function, must always be the same. However, integrated-circuit manufacturing processes result in capacitors that may have tolerances within ±20%, which will result in imprecise measurements. Moreover, current generators in such integrated circuits may have tolerance that are also within ±20%, further compounding delta-T measurement errors. It can readily be discerned that if the ramp in FIG. 4 had a slightly different slope because of tolerance characteristics, the delta-T to delta-V transformation would be erroneous. In accordance with the present invention, these tolerances are corrected by automatically and dynamically normalizing the integrator ramp voltage to a predetermined amplitude for a given known time period. The word "normalize" used herein has the ordinary meaning as understood in the electronic test and measurement industry, and is defined in the IEEE Standard Dictionary of Electrical and Electronic Terms, published as ANSI/IEEE Standard 100-1988, as "to adjust a measured parameter to a value acceptable to an instrument or measurement technique." Here, the ramp is normalized to the voltage window of an analog-to-digital converter, and is always the same for every measurement.

Figure 4:
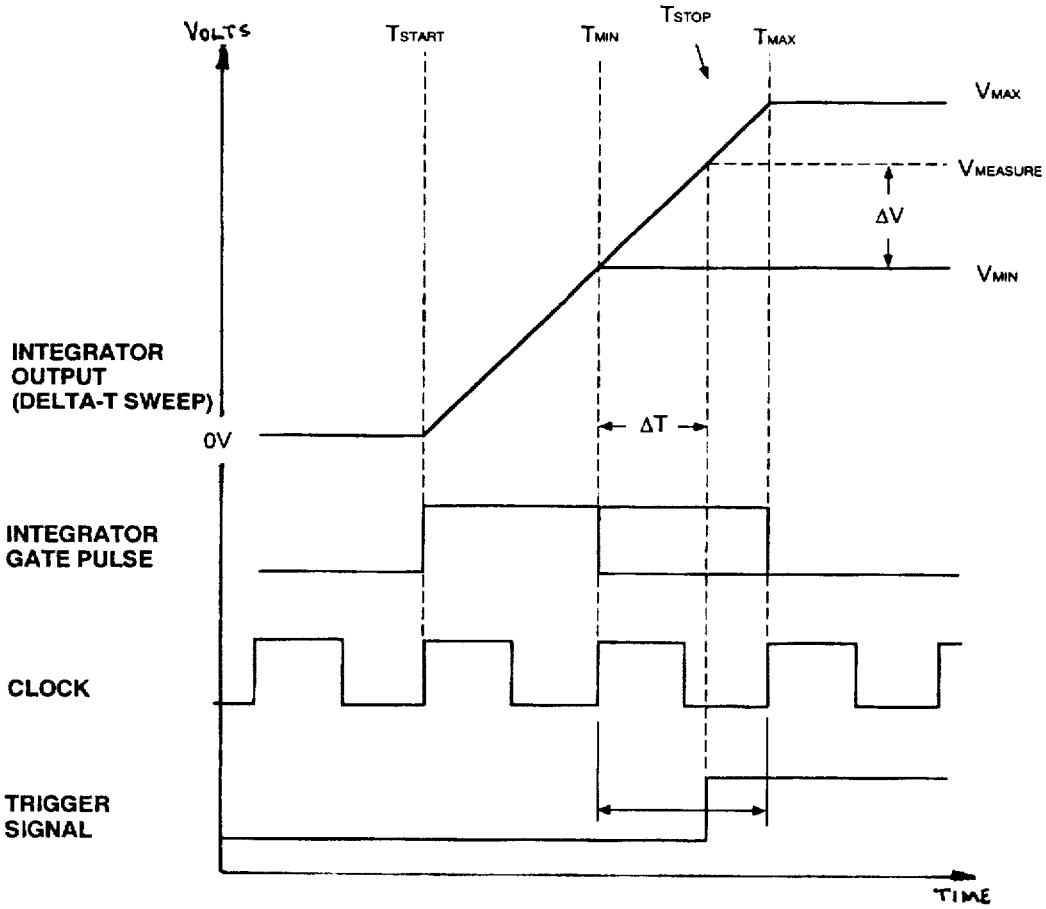
FIG. 4 is a waveform diagram to explain the delta-T measurement circuit of FIG. 3.
Figure 5:
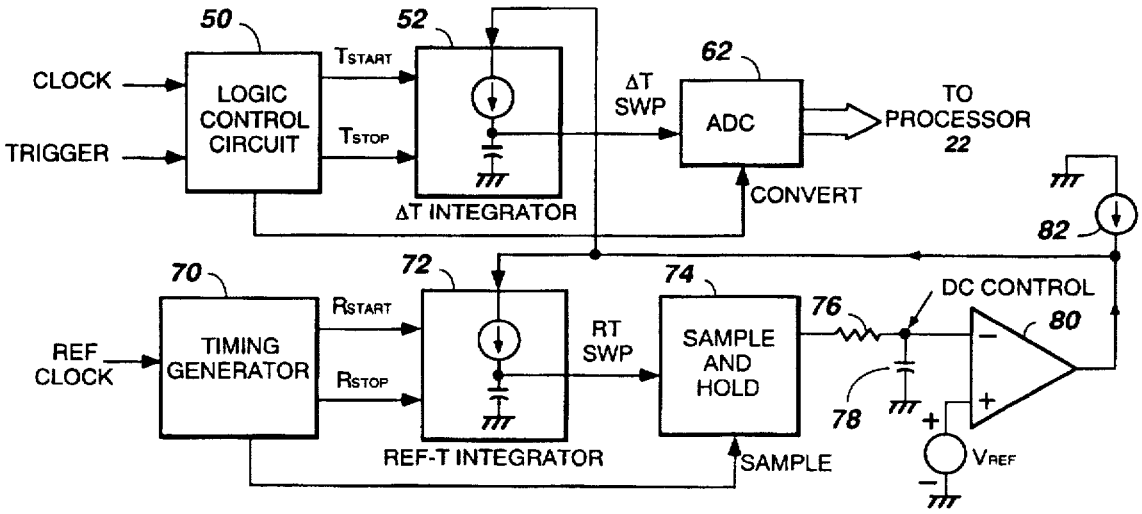
FIG. 5 is a delta-T measurement circuit having a correction circuit in accordance with the present invention.

FIG. 5 shows a detailed block diagram of a delta-T measurement circuit including a circuit to automatically and dynamically normalize the integrator ramp voltage to a predetermined slope in accordance with the present invention. Logic control circuit 50, delta-T integrator 52, and ADC 62 are substantially as described in connection with FIG. 3, with the exception that the current for the delta-T integrator 52 is corrected to normalize the ramp voltage for the delta-T sweep as shown in FIG. 4. The necessary current correction for the delta-T integrator is provided by a reference circuit having a substantially identical integrator to be described in conjunction with the waveforms shown in FIG. 6.

Figure 6:
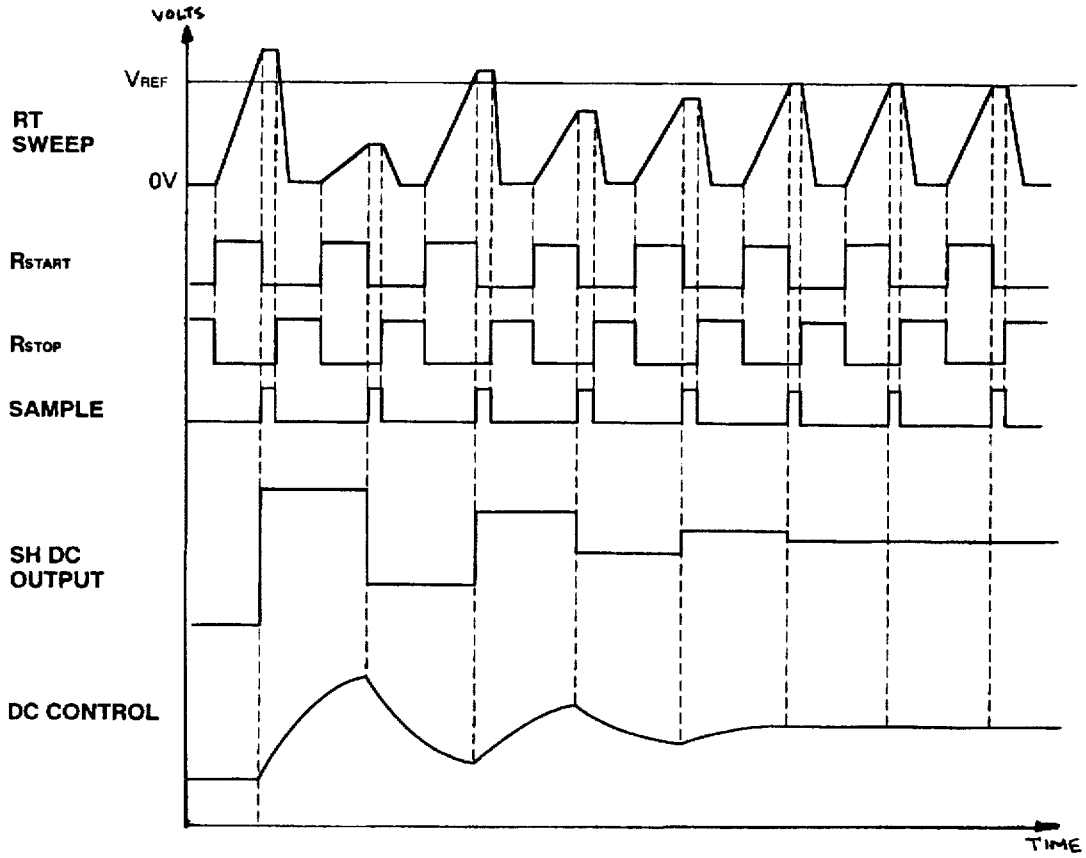
FIG. 6 is a waveform diagram to explain the correction circuit portion of FIG. 5.

A timing generator 70 receives a reference clock signal which has the same timing as the sample clock received by logic control circuit 50, and continuously generates $R_{START}$, $R_{STOP}$, and sample pulses in the sequence shown in FIG. 6. A reference-T integrator 72, which is substantially identical to delta-T integrator 52 and is preferably located within the same integrated circuit and thus has been subjected to the same manufacturing process, generates reference sweeps whose time duration is equal to two complete clock cycles and therefore is the same time duration as the delta-T sweep. When the reference sweep reaches its maximum voltage value for each sweep, a sample-and-hold circuit 74 takes a sample of the peak voltage. Sample-and-hold circuit 74 acts like a rectifier, but it is fast acting, avoids an extra dominant pole in the control loop, and isolates the following control circuitry from the integrator output. The sample-and hold output voltage (SH DC output) is applied to an RC network comprising resistor 76 and capacitor 78, producing an RC-controlled DC control voltage that is applied to the inverting input of a loop amplifier 80 that also has a reference voltage applied to its non-inverting input. The RC network 76–78 also provides a well-fixed dominant pole for the control loop. The reference voltage $V_{REF}$ is equal to $V_{MAX}$ to set the peak values of ramp voltage outputs of integrators 52 and 72. Loop amplifier 80 converts the voltage difference at its inputs to a current which is added to a current provided by current generator 82 to be applied to integrators 52 and 72 as charging current for the respective integrator capacitors.

The waveforms of FIG. 6 represent action of the reference circuit from power-up, that is, when power is first applied to the instrument. On the first reference-T sweep cycle, the peak value of the ramp exceeds $V_{REF}$, causing the sampled voltage to in turn produce a DC control voltage at the junction of resistor 76 and capacitor 78 of a magnitude sufficient to reduce the current output of amplifier 80. On the second reference-T sweep cycle, the peak value of the ramp is reduced because of the reduced charging current furnished by amplifier 80. In turn, the sampled voltage and DC control voltage are lowered, increasing the current output of amplifier 80 so that on the third reference-T sweep cycle, the peak value of the ramp again exceeds $V_{REF}$, but not by as much as it did on the first cycle. After a few cycles following turn-on (after 10 to 20 microseconds in the commercial embodiment in which the sampling clock frequency is 25 megahertz), the peak values of the reference-T ramps converge to $V_{REF}$, with amplifier 80 providing whatever current is necessary to correct process and component deviations. This in turn causes the delta-T ramps to be normalized to a peak value of $V_{MAX}$. Since the deviations of the two integrators 52 and 72 are the same, $V_{REF}=V_{MAX}$. Once the steady state is reached, the reference circuit continues to operate, and delta-T measurements may be made with a high degree of accuracy. Thus, the current source and capacitor used to make accurate delta-T measurements are both independent of manufacturing process deviations.

While I have shown and described the preferred embodiment of my invention, it will be apparent to those skilled in the art that many changes and modifications may be made without departing from my invention in its broader aspects. For example, amplifier 80 could generate a control voltage to control current generators internal to integrators 52 and 72 with substantially the same results. It is therefore contemplated that the appended claims will cover all such changes and modifications as fall within the true scope of the invention.

What I claim as my invention is:

1. A differential time measurement circuit for measuring a differential time period between a periodic clock pulse and an asynchronous event pulse, comprising:

a logic circuit for generating a start control signal in response to a clock pulse and a stop control signal in response to an asynchronous event pulse;

a time-to-voltage converter coupled to said logic circuit and being responsive to said start and stop control signals to develop a differential voltage proportional to said differential time period;

an analog-to-digital converter coupled to said time-to-voltage converter to convert said differential voltage to digital data representative of said differential time period; and a reference circuit responsive to said periodic clock pulses and a predetermined differential voltage to provide to said time-to-voltage converter an electrical time-to-voltage transfer function normalized to a predetermined time period derived from said periodic clock pulses and a predetermined amplitude derived from said differential voltage.

2. A differential time measurement circuit in accordance with claim 1 wherein said time-to-voltage converter is a measurement integrator having a capacitor charged by a substantially constant current thereby to generate a substantially linear ramp voltage.

3. A measurement circuit in accordance with claim 2 wherein said reference circuit includes a reference integrator that is substantially identical to said measurement integrator, a timing generator coupled to said reference integrator and being responsive to said periodic clock pulses to operate said reference integrator for said predetermined time period, and a correction loop coupled to the output of said reference integrator for dynamically correcting the slopes of the linear ramp voltage outputs of both said measurement integrator and said reference integrator in accordance with said predetermined differential time and said predetermined differential voltage.

4. A differential time measurement circuit in accordance with claim 3 wherein said correction loop comprises a sample-and-hold circuit connected to the output of said reference integrator to sample the maximum output ramp voltage produced by said reference integrator, and an error amplifier for comparing said sampled maximum output ramp voltage with a reference voltage to generate a correction signal to correct the charging currents of said measurement integrator and said reference integrator.

5. A circuit for measuring the time difference between a first event and a second event, comprising:

a first integrator circuit having a capacitor that is charged linearly for a time duration between said first event and said second event to produce a measurement voltage that is proportional to said time duration;

an analog-to-digital converter for converting said measurement voltage to digital data representative of said time duration;

a second integrator substantially identical to said first integrator and producing reference linear ramp voltages in response to reference timing signals that define a predetermined time period;

a sample-and-hold circuit for sampling maximum values of said reference linear ramp voltages; and an error amplifier for generating an error current proportional to the difference between said peak voltages and a predetermined reference voltage, wherein said error current is provided to said first and second integrators to normalize the output voltages thereof to a predetermined maximum voltage over said predetermined time period.

6. A differential time measurement circuit for measuring a differential time period between a sampling clock pulse and a trigger signal in a digital oscilloscope, comprising:

a logic circuit for generating a start control signal in response to a sampling clock pulse and a stop control signal in response to a trigger signal;

a time-to-voltage converter coupled to said logic circuit and being responsive to said start and stop control signals to develop a differential voltage proportional to said differential time period;

an analog-to-digital converter coupled to said time-to-voltage converter to convert said differential voltage to digital data representative of said differential time period; and a reference circuit responsive to said sampling clock pulses and a predetermined differential voltage to provide to said time-to-voltage converter an electrical time-to-voltage transfer function normalized to a predetermined time period derived from said sampling clock pulses and a predetermined amplitude derived from said differential voltage.

* * * * *